US006701854B1

(12) United States Patent
Gral

(10) Patent No.: US 6,701,854 B1
(45) Date of Patent: Mar. 9, 2004

(54) DETONATOR TO BE INSTALLED IN A CHAMBER AND SAFETY CONTAINER COMPRISING IT

(75) Inventor: René Gral, La Garenne Colombes (FR)

(73) Assignee: Val'Protect S.A., Courbevoie (FR)

( * ) Notice: Subject to any disclaimer, the term of this patent is extended or adjusted under 35 U.S.C. 154(b) by 0 days.

(21) Appl. No.: 09/445,759

(22) PCT Filed: Jun. 11, 1998

(86) PCT No.: PCT/FR98/01215

§ 371 (c)(1),
(2), (4) Date: May 12, 2000

(87) PCT Pub. No.: WO98/57115

PCT Pub. Date: Dec. 17, 1998

(Under 37 CFR 1.47)

(30) Foreign Application Priority Data

Jun. 11, 1997 (FR) ..... 97 07252

(51) Int. Cl.[7] ..... E05G 1/14

(52) U.S. Cl. ..... 109/25; 109/29; 109/33; 109/36; 102/254; 102/256

(58) Field of Search ..... 109/25, 29–34, 109/36, 37; 102/256, 254, 275.6; 86/50

(56) References Cited

U.S. PATENT DOCUMENTS

| | | | | |
|---|---|---|---|---|
| 1,422,903 A | * | 7/1922 | Tiffany | |
| 1,454,894 A | * | 5/1923 | Johnson | 109/36 |
| 1,859,122 A | * | 5/1932 | Young | |
| 1,934,732 A | * | 11/1933 | Nahm et al. | |
| 3,015,275 A | | 1/1962 | Peyton et al. | |
| 3,643,609 A | | 2/1972 | Maywald et al. | 109/29 |
| 3,650,226 A | * | 3/1972 | Conroy et al. | 109/25 |
| 3,676,945 A | * | 7/1972 | Neanhouse | 109/33 X |
| 3,732,830 A | | 5/1973 | Lindstedt, Jr. | 109/36 |
| 3,889,601 A | * | 6/1975 | Koehne et al. | 102/90 |
| 4,236,463 A | * | 12/1980 | Westcott | 109/33 |
| 5,454,322 A | * | 10/1995 | Sakamoto et al. | 102/247 |
| 5,549,047 A | * | 8/1996 | Borgni | 102/256 |
| 5,594,195 A | * | 1/1997 | Lenko et al. | 102/260 |
| 5,598,793 A | * | 2/1997 | Lopez, Jr. | 109/25 |

FOREIGN PATENT DOCUMENTS

| | | |
|---|---|---|
| DE | 41 37 346 | 5/1992 |
| EP | 0 188 155 | 7/1986 |
| GB | 1 112 934 | 5/1968 |
| GB | 1 138 104 | 12/1968 |
| GB | 1 161 869 | 8/1969 |

* cited by examiner

*Primary Examiner*—Lloyd A. Gall
(74) *Attorney, Agent, or Firm*—Young & Thompson

(57) ABSTRACT

A detonator is intended to be installed in a chamber equipped with a blockable access opening. The detonator includes a member for initiating a pyrotechnic chain and a casing for confining the initiation member. The casing includes, facing the initiation member, a port for igniting a pyrotechnic charge placed in the chamber outside the casing. The detonator also includes a shutter for blocking the port which can be moved between a retracted position clear of the port and a position for blocking the port. A device for operating the shutter keeps the shutter in the retracted position when access to the chamber is blocked, and in the blocking position when access to the chamber is open.

18 Claims, 2 Drawing Sheets

DETONATOR TO BE INSTALLED IN A CHAMBER AND SAFETY CONTAINER COMPRISING IT

BACKGROUND OF THE INVENTION

The present invention relates to a detonator intended to be installed in a chamber equipped with a blockable access opening, of the type comprising a member for initiating a pyrotechnic chain.

The invention also relates to a security container of the type comprising a chamber equipped with a blockable access opening and, placed in the said chamber, a pyrotechnic charge associated, within a pyrotechnic chain, with a triggering detonator also placed in the said chamber.

A security container of this type is described, for example, in document EP-A-0,188,155.

In this document, the container is intended for the transportation of valuables, especially banknotes.

The pyrotechnic charge is formed by a detonating cutting cord which is initiated by a detonator. The cutting cord and the charge are both placed inside the lid of the container.

The presence of detonating pyrotechnic means is a source of substantial risk to the user of the container.

In particular, when access to the container is open, accidental triggering of the detonator causes the firing of the pyrotechnic charge and may thus cause serious injury to anybody in the vicinity of the open container.

SUMMARY OF THE INVENTION

The object of the invention is to provide a solution to this safety problem preventing the risk of injury to those responsible for handling the valuables contained in security containers equipped with pyrotechnic means.

To this end, the subject of the invention is a detonator intended to be installed in a chamber equipped with a blockable access opening, of the aforementioned type, characterized in that it comprises a casing for confining the said initiation member, which casing comprises, facing the said initiation member, a port for igniting a pyrotechnic charge placed in the said chamber outside the said casing, in that it comprises a shutter for blocking the said port which can be moved between a retracted position clear of the said port and a position for blocking this port, and in that it comprises means of operating the said shutter which are designed to keep it in its retracted position when access to the said chamber is blocked, and keep it in its blocking position when access to the said chamber is open.

According to particular embodiments, the detonator may have one or more of the following features:

- it comprises a spring urging the said shutter into its position of blocking the said port, and the said operating means comprise a push-rod designed to move the said shutter clear when blocking the said access;
- the said push-rod at least partially bears the pyrotechnic charge, and a part of the pyrotechnic charge can be moved with respect to the casing to take the place of the blocking shutter facing the said port;
- it comprises a pyrotechnic initiation relay between the said port and the said initiation member; and
- the said operating means comprise an actuator, particularly an electromagnet, for moving the said shutter, which actuator is connected to a control unit comprising means of detecting whether or not the said access to the chamber is open.

Another subject of the invention is a security container of the aforementioned type, characterized in that the said detonator is a detonator as defined earlier.

According to one of the particular embodiments, the container has one or more of the following features:

- it comprises means of locking the access and the member for initiating the pyrotechnic chain is connected to an electric control circuit via a switch that selectively connects the said initiation member to the said electric control circuit, and it comprises mechanical means of operating the said switch in order to connect the said pyrotechnic initiation member when the said access is locked and disconnect the said pyrotechnic initiation member when the said access is unlocked;
- it comprises two articulated half-shells forming a suitcase and a detonator housed in the said suitcase, and the said casing for the detonator is fixed to a first half-shell, the push-rod being fixed to the second half-shell facing the said casing; and
- the access opening comprises a door and the said chamber forms a strongbox, the said detection means comprising sensors that sense whether or not the said door is open.

BRIEF DESCRIPTION OF THE DRAWINGS

The invention will be better understood from reading the description which will follow, given merely by way of example and made with reference to the drawings in which.

DETAILED DESCRIPTION OF THE PREFERRED EMBODIMENTS

Figure 1:
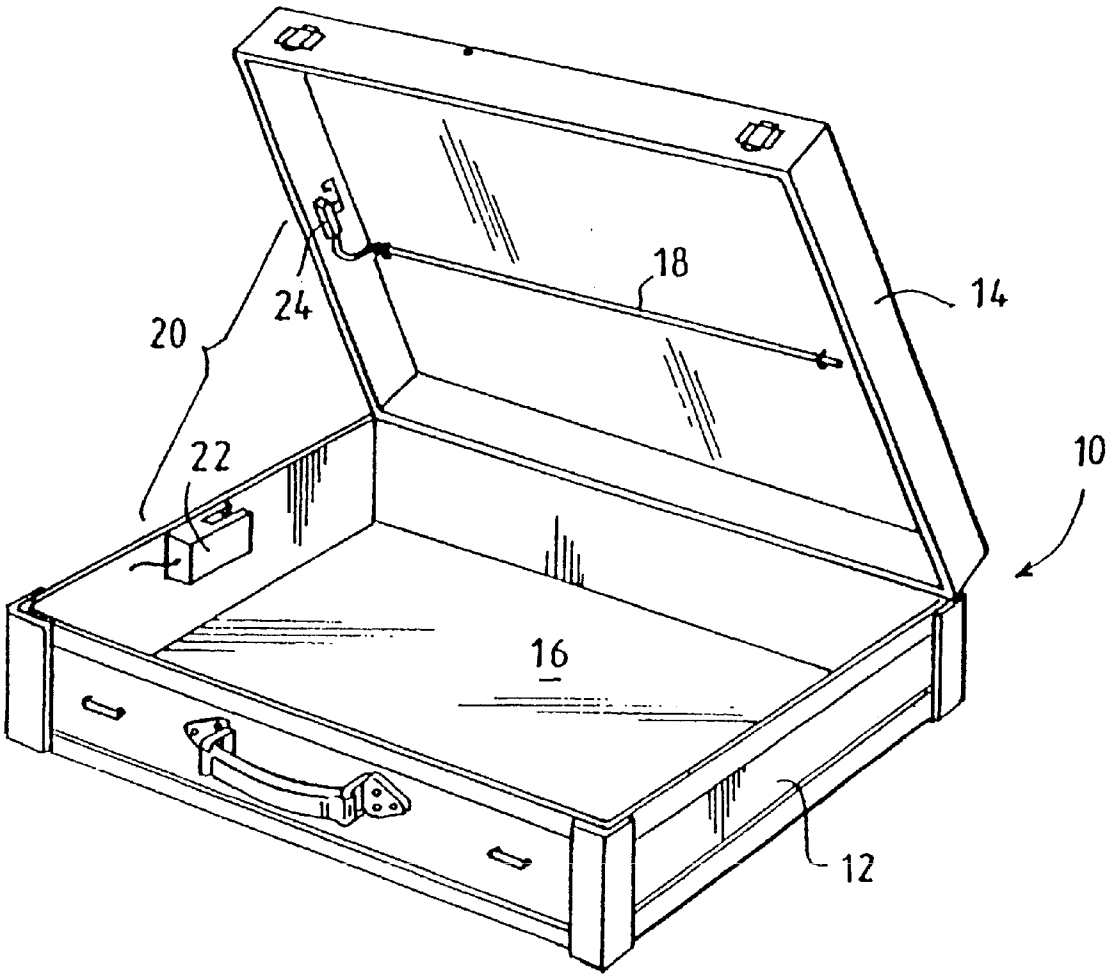
FIG. 1 is a view in perspective of an open security suitcase according to the invention.

The suitcase 10 depicted in FIG. 1 comprises two half-shells 12 and 14 articulated together.

This suitcase forms a security container delimiting a chamber 16 for holding valuables to be transported, such as banknotes, computer data media or electronic components.

The chamber 16 is equipped with an opening in its upper part. This access opening can be blocked by the upper half-shell 14 which forms a lid.

A pyrotechnic charge 18 formed by a detonating cutting cord is fixed along the entire length of the interior face of the lid 14. This pyrotechnic charge is designed to destroy the valuables contained in the container, at least partially, in the event of any attempt to tamper with this container. This pyrotechnic charge is advantageously associated with means for throwing ink over the valuables contained in the suitcase. These throwing means are formed, for example, by ink reservoirs with frangible walls.

The cord 18 is connected to a detonator 20 designed to trigger the pyrotechnic charge. This detonator comprises a first part denoted 22, fixed to the lower half-shell 12 of the suitcase, and a second part denoted 24, fixed to the lid 14 facing the first part 22.

Figure 3:
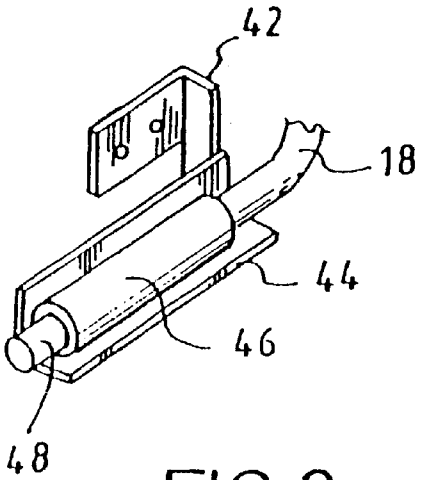
FIGS. 2 and 3 are views in perspective on a larger scale, of the two parts of the detonator of the suitcase of FIG. 1.
Figure 2:
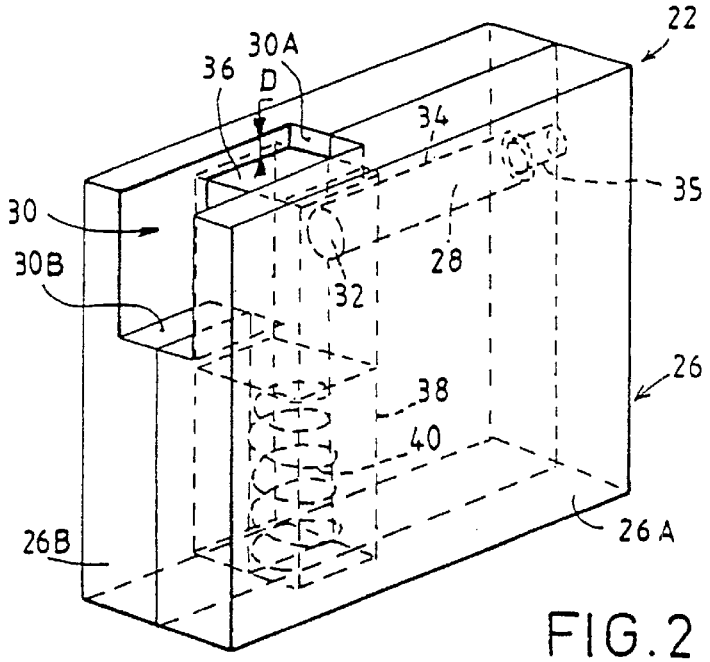

These first and second parts are depicted in FIGS. 2 and 3 respectively.

The first part 22 is electrically connected to a control unit, not depicted, itself connected to sensors that detect an attempt to break into the suitcase. These sensors are, for example, sensors that sense opening or alternatively, displacement sensors.

As depicted in FIG. 2, the first part 22 of the detonator comprises a confinement casing 26 in which an electrically controllable member 28 for initiating the pyrotechnic chain is placed.

The casing 26 is produced by the assembly of two symmetrical half-shells denoted 26A, 26B, formed from machined solid metal blocks. From the outside, this casing is approximately in the shape of a rectangular parallelepiped.

It comprises a cut-out 30 formed at the centre of a corner, secant to the longitudinal mid-plane along which the two half-shells 26A, 26B are joined. A port 32 is formed facing the said initiation member 28. It opens out into a face 30A of the cut-out 30.

Advantageously, the initiation member 28 has an approximately cylindrical shape and is placed in a cylindrical duct 34 extended by the port 32.

The other end of the duct 34 is, extended by an opening 35 intended for the passage of the wires from the control unit.

A shutter 36 formed by a metallic cube is mounted so that it can be moved by sliding in a blind duct 38 of square section extending at right angles to the axis of the initiation member 28. The duct 38 opens out only onto the second main face, denoted 30B, of the cut-out. The ducts 34 and 38 extend at right angles to one another.

In the direction at right angles to the axis of the ducts 34 and 38, the shutter 36 has a length that slightly exceeds the width of the cut-out 30. In addition, the duct 38 is interrupted a distance D away from the upper face of the detonator, which means that the shutter 36 is held captive inside the duct 38.

The shutter 36 can be moved from a position of blocking the port 32 (the position depicted in FIG. 2) as far as a position retracted into the blind part of the duct 38, in which position the opening 32 is clear. In the blocking position, the shutter 36 is in contact with the face 30A of the cut-out.

A coil spring 40 is placed in the duct 38. It is kept loaded between the closed end of the blind duct and the shutter 36 and urges the latter into its blocking position.

The second part 24 of the detonator forms a push-rod intended to actuate the shutter 36 and more specifically to retract the latter into the duct 38.

The push-rod 24 comprises a bracket 42 for attaching to a side wall of the lid 14 of the suitcase. Fixed to the end of this bracket is a V section 44 intended to support part of the pyrotechnic charge 18.

For this, a tube 46 with an inside diameter slightly exceeding the outside diameter of the cord 18 is welded into the corner delimited by the section 44.

The cord 18 passes right through the tube 46 and one end, denoted 48, of the cord 18 protrudes from one of the, ends of the tube 46.

As depicted in FIG. 1, the push-rod 24 is fixed to the interior face of a side wall of the lid 14, while the body 22 ,of the detonator is fixed facing the push-rod on the interior face of the corresponding wall of the lower half-shell 12 of the suitcase.

When the suitcase is open, as, depicted in FIG. 1, the shutter 36, urged by the spring 40, is kept in the position of blocking the port 32. Thus, any accidental triggering of the initiation member has no consequence detrimental to anybody in the vicinity of the suitcase, because the explosion is then confined inside the casing 26.

However, when the lid 14 of the suitcase is closed, the push-rod 24, and in particular the lower face of the section 44 pushes the blocking shutter 36 into the blind part of the duct 38.

Thus, the end 48 of the cutting cord takes the place of the shutter 36 immediately facing the port 32. The end 48 is then aligned with the initiation member 28.

If one of the sensors detects an attempt at breaking into the suitcase, the triggering of the initiation member 28 causes the firing of the cutting cord 18 which then destroys the valuables contained within the suitcase.

In order further to improve safety when opening the suitcase, the latter comprises means of opening the circuit that powers the member for initiating the pyrotechnic chain when the suitcase is unlocked.

In particular, the suitcase comprises, for locking it, a motorized catch connected to a control device for operating the locking and unlocking of the suitcase. In order to prevent the powering of the pyrotechnic initiation member when the suitcase is unlocked, the keeper of the motorized catch is associated with a push-button placed in the power supply circuit of the initiation member. When the keeper is in the locked position, it depresses the push-button so that the initiation member can be supplied with power. When the keeper of the motorized catch is in the position for unlocking the suitcase, the push-button is released, which means that the initiation member power-supply circuit is open.

It will thus be understood that when the suitcase is unlocked, the initiation member cannot be powered which means that it is impossible for the pyrotechnic chain to be fired.

Figure 4:
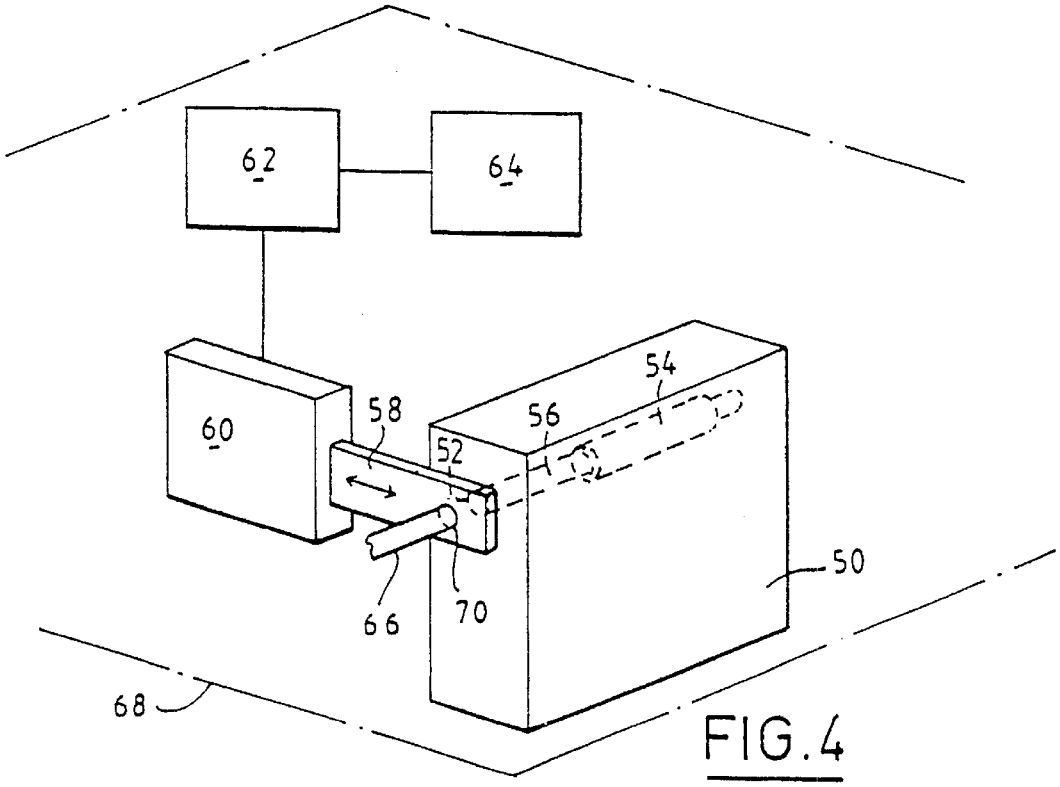
FIG. 4 is a partially diagrammatic view in perspective of a detonator according to the invention, intended for a strongbox.

FIG. 4 depicts, in perspective, a detonator according to the invention designed to be employed in a strongbox fitted with a door.

In this embodiment, the detonator is formed as before from two solid machined half-shells joined together. The confinement casing 50 thus formed comprises a port 52 aligned with an initiation member 54 housed inside the confinement casing.

A pyrotechnic initiation relay 56 is placed between the initiation member 54 and the port 52.

A shutter 58, similar to the shutter 36, is formed by a metal bar that can be moved in translation between a position of blocking the port 52 (which position is depicted in FIG. 4) and a retracted position clear of this port. The bar 58 is operated by an actuator 60 formed by an electromagnet.

The actuator 60 is controlled by a control unit 62, itself connected to sensors 64 that detect whether the door of the strongbox is open.

Furthermore, the interior of the strongbox is fitted, as before, with a detonating cutting cord denoted 66, just part of which has been depicted in the figure.

This cord, like the casing of the detonator, is fixed into the chamber delimited by the strongbox. This chamber is denoted 68.

One end, denoted 70, of this cord is placed facing the port 52. Enough space is left between the port 52 and the end of the cord to allow the bar 58 to pass.

In this embodiment, the control unit 62 is programmed to control the shutter 58 in order, on the one hand, to keep it in its retracted position when access defined by the door to the chamber is blocked, and on the other hand to keep the shutter in its blocking position when access to the chamber is authorized.

As before, it will be understood that when the door to the box is open, the shutter 58 confines the initiation member 54 and the pyrotechnic initiation relay 56 within the casing 50 so that any accidental triggering is without danger.

However, when the door to the box is closed, the shutter 58 is moved clear so that the continuity of the pyrotechnic chain is once more ensured. Thus, activation of the initiation member 54 causes the firing of the pyrotechnic initiation relay 56 which in turn triggers the cutting cord 66.

The pyrotechnic initiation relay 56 transfers the flame from inside the casing as far as the end 70 of the cord. In particular, it allows the flame to pass across the space formed for the passage of the shutter 58.

A detonator as described here can be installed in any chamber equipped with an opening. In particular, it can be installed in a building or a work room. In such cases, access is blocked by a door. The initiation member is then confined on the basis of whether or not the door is open, in order to prevent the pyrotechnic chain from being triggered when the door is open.

Likewise, a detonator of this kind may be installed in a security cabinet in which a collection of keys or electronic cards is stored.

What is claimed is:

1. Detonator for installation in a chamber equipped with a blockable access opening, comprising:

a member for initiating a pyrotechnic chain, a casing for confining said initiation member, a pyrotechnic charge adapted to be placed in a chamber equipped with a blockable access opening, outside said casing, said casing comprising a port for igniting said pyrotechnic charge, facing said initiation member, a shutter for blocking said port which can be moved between a retracted position clear of said port and a position for blocking said port, and means for operating said shutter which are adapted to keep the shutter in said retracted position when access to the chamber is blocked, and keep the shutter in said blocking position when access to the chamber is open.

2. Detonator according to claim 1, characterized in that it comprises a spring (40) urging the said shutter (36) into its position of blocking the said port (32), and in that the said operating means comprise a push-rod (24) designed to move the said shutter (36) clear when blocking the said access.

3. Detonator according to claim 2, wherein said push-rod at least partially bears the pyrotechnic charge, and a part of the pyrotechnic charge can be moved with respect to the casing to take the place of the blocking shutter facing said port.

4. Detonator according to claim 1, characterized in that it comprises a pyrotechnic initiation relay (56) between the said port (52) and the said initiation member (54).

5. Detonator according to claim 1, characterized in that the said operating means comprise an actuator, for moving the said shutter (58), which actuator is connected to a control unit (62) comprising means (64) of detecting whether or not the said access to the chamber is open.

6. Security container of the type comprising a chamber (16; 68) equipped with a blockable access opening and, placed in the said chamber, a pyrotechnic charge (18; 66) associated in a pyrotechnic chain with a triggering detonator also placed in the said chamber, characterized in that the said detonator (20; 50) is a detonator according to claim 5.

7. Container according to claim 6, characterized in that it comprises means of locking the access and the member for initiating the pyrotechnic chain is connected to an electric control circuit via a switch that selectively connects the said pyrotechnic initiation member to the said electric control circuit, and in that it comprises mechanical means of operating the said switch in order to connect the said initiation member when the said access is locked and disconnect the said pyrotechnic initiation member when the said access is unlocked.

8. Container according to claim 6, characterized in that it comprises two articulated half-shells (12; 14) forming a suitcase and a detonator (20) housed in the said suitcase, and in that the said casing (26) for the detonator is fixed to a first half-shell (12), the push-rod (24) being fixed to the second half-shell (14) facing the said casing (26).

9. Container according to claim 6, characterized in that the access opening comprises a door and the said chamber (68) forms a strongbox, the said detection means comprising sensors (64) that sense whether or not the said door is open.

10. Security container of the type comprising a chamber equipped with a blockable access opening and, placed in said chamber, a pyrotechnic charge associated in a pyrotechnic chain with a triggering detonator also placed in said chamber, wherein said detonator is a detonator according to claim 1.

11. A detonator for installation in a chamber, said detonator comprising:

an initiation member for initiating a pyrotechnic chain;

a casing for confining the initiation member;

a pyrotechnic charge facing a first end of said initiation member;

a shutter movable from a first position between said first end and said pyrotechnic charge and a second position so that the pyrotechnic charge is directly facing said first end;

a shutter operating device for keeping said shutter in the first position when the chamber is open and for keeping said shutter in the second position when the chamber is closed.

12. The detonator as claimed in claim 11, further comprising a biasing element urging said shutter into said first position.

13. The detonator as claimed in claim 12, wherein said shutter operating device comprises a push-rod for urging said shutter into the second position.

14. The detonator as claimed in claim 11, wherein the casing comprises a cut-out, said shutter sliding in said cut-out.

15. The detonator as claimed in claim 11, wherein the casing comprises a cylindrical duct for containing said initiation member.

16. The detonator as claimed in claim 15, wherein the cylindrical duct comprises an opening, said shutter being movable to block and unblock said opening.

17. A security container comprising:

a chamber;

a pyrotechnic charge within said chamber; and a detonator within said chamber, said detonator comprising:

an initiation member for initiating a pyrotechnic chain, said pyrotechnic charge facing a first end of said initiation member;

a casing for confining the initiation member;

a shutter movable from a first position between said first end and said pyrotechnic charge and a second position so that the pyrotechnic charge is directly facing said first end;

means for operating said shutter for keeping said shutter in the first position when the chamber is open and for keeping said shutter in the second position when the chamber is closed.

18. The security container as claimed in claim 17, wherein the pyrotechnic charge is a cord.

* * * * *